US010493478B2

(12) United States Patent
Arminak

(10) Patent No.: US 10,493,478 B2
(45) Date of Patent: Dec. 3, 2019

(54) HAND PUMP WITH FOLDING NOZZLE

(71) Applicant: Armin Arminak, Pasadena, CA (US)

(72) Inventor: Armin Arminak, Pasadena, CA (US)

( * ) Notice: Subject to any disclaimer, the term of this patent is extended or adjusted under 35 U.S.C. 154(b) by 0 days.

(21) Appl. No.: 15/946,436

(22) Filed: Apr. 5, 2018

(65) Prior Publication Data

US 2019/0015860 A1 Jan. 17, 2019

Related U.S. Application Data

(60) Provisional application No. 62/532,940, filed on Jul. 14, 2017.

(51) Int. Cl.

| | |
|---|---|
| ***B05B 11/00*** | (2006.01) |
| ***F04B 23/02*** | (2006.01) |
| ***F04B 9/14*** | (2006.01) |

(52) U.S. Cl.

CPC ..... *B05B 11/3059* (2013.01); *B05B 11/0094* (2013.01); *B05B 11/3001* (2013.01); *B05B 11/306* (2013.01); *F04B 9/14* (2013.01); *F04B 23/02* (2013.01); *F04B 23/023* (2013.01); *B05B 11/3023* (2013.01); *B05B 11/3047* (2013.01)

(58) Field of Classification Search

CPC ..... B05B 11/3059; B05B 11/3001; B05B 11/306; B05B 11/3025; B05B 11/3074; B05B 11/0094; B05B 11/3047; B05B 11/3023; F04B 9/14; F04B 23/023; F04B 23/02; F04B 9/023

USPC ..... 222/527–530

See application file for complete search history.

(56) References Cited

U.S. PATENT DOCUMENTS

| | | | | |
|---|---|---|---|---|
| 3,367,540 A * | 2/1968 | Lehmann | B65D 83/20 222/153.06 |
| 3,797,705 A * | 3/1974 | Cooprider | B05B 11/3059 222/153.13 |
| 3,827,606 A * | 8/1974 | Knickerbocker | B05B 11/3059 222/384 |
| 3,874,562 A | 4/1975 | Hazard | |
| 3,907,174 A * | 9/1975 | Steiman | B05B 11/3001 222/153.13 |

(Continued)

FOREIGN PATENT DOCUMENTS

| | | |
|---|---|---|
| GB | 1466436 | 3/1977 |
| JP | 08038959 | 2/1996 |

(Continued)

OTHER PUBLICATIONS

USPTO, International Search Report and Written Opinion issued in related International Patent Application No. PCT/US2018/029632 dated Jul. 6, 2018, 16 pages.

*Primary Examiner* — Donnell A Long
(74) *Attorney, Agent, or Firm* — Cislo & Thomas, LLP

(57) ABSTRACT

A hand pump design that utilizes an actuator with a folding nozzle suitable for use in e-commerce is presented. The folding nozzle equipped pump actuator forms part of a hand pump assembly which incorporates a pump body assembly comprising upper and lower pump bodies and a sliding collar which controls the inlet of fluid to be dispensed into fluid passages in the pump assembly and subsequently into the pump actuator. The hand pump further includes upper and lower check balls to prevent back flowing of the fluid to be dispensed into the dispenser bottle.

22 Claims, 10 Drawing Sheets

(56) References Cited

U.S. PATENT DOCUMENTS 4,065,036 A * 12/1977 Kirk, Jr. ..... B05B 11/3059 222/153.13
4,162,746 A * 7/1979 Anderson ..... B05B 11/3059 166/270.1
4,318,403 A * 3/1982 Sneider ..... A61M 3/0262 222/538
4,420,096 A * 12/1983 Kirk, Jr. ..... B05B 11/3059 222/321.9
4,479,589 A 10/1984 Ford
4,650,100 A * 3/1987 Echazabal, Jr. ..... B65D 25/465 222/475
4,819,832 A 4/1989 Lawson
5,143,237 A 1/1992 Lindsey et al.
5,871,126 A * 2/1999 Bennett ..... B05B 11/007 222/207
6,334,549 B1 1/2002 Fernandez et al.
6,536,630 B1 * 3/2003 Chan ..... B05B 11/3008 222/207
6,966,459 B1 * 11/2005 Tseng ..... B05B 11/305 222/153.13
7,249,692 B2 7/2007 Walters et al.
2007/0045349 A1 * 3/2007 Foster ..... B05B 11/3023 222/321.9
2010/0006606 A1 1/2010 Lee
2015/0305576 A1 * 10/2015 Hall ..... A47K 5/12 222/135
2016/0303600 A1 * 10/2016 Dalisay ..... B05B 11/3052
2017/0021376 A1 * 1/2017 Espinoza ..... B05B 11/3001
2018/0353984 A1 * 12/2018 Masciambruni .... B05B 11/0027

FOREIGN PATENT DOCUMENTS

JP 10101115 4/1998
WO 2017081594 5/2017
WO 2017140542 8/2017

* cited by examiner

HAND PUMP WITH FOLDING NOZZLE

CROSS-REFERENCE TO RELATED APPLICATION

This application claims the benefit of U.S. Provisional Application Ser. No. 62/532,940, filed Jul. 14, 2017 and entitled "A Hand Pump Actuator with Folding Nozzle Suitable for Ecommerce, which is incorporated herein by this reference.

BACKGROUND OF THE INVENTION

Field of the Invention

This invention relates to liquid dispensing pumps for dispensing fluids without the use of aerosol propellants.

Background Art

Hand operated pump dispensers are well known in the personal care industry for dispensing fluid products such as liquids and creams. Pumps of this type generally include a pump leading to a dip tube, which is inserted into the fluid reservoir. The actuator assembly is sealed air tight to the mouth of the reservoir. Typically, the actuator assembly includes a piston, a spring and an inner valve. This enables the definition of a dose of the fluid product expelled out of the container through the nozzle on each pressing or actuation of the pump. Prior art hand pumps typically include dispensing nozzles that extend from the actuator which require that they be packaged so as to prevent nozzle breakage during shipping. This limitation makes prior art pumps generally unsuitable for use in e-commerce where products are often shipped with no special packaging to prevent breakage.

SUMMARY OF THE INVENTION

The present invention provides a new hand pump design that utilizes a pump actuator equipped with a folding nozzle. The new hand pump is particularly suitable for use in e-commerce where the hand pump and a filled dispenser bottle are commonly shipped unboxed. The use of a pump actuator with a folding nozzle, in addition to eliminating the protrusion of a conventional nozzle, helps to prevent the pump actuator and closure from loosening and unlocking during shipping.

The ability of the hand pump to resist loosening and unlocking during shipping is enhanced by providing the hand pump with an actuator, a closure and a nozzle that are free of any sharp edges, surface discontinuities or protrusions that may catch on other containers or packaging during shipping. The ability of the hand pump to resist loosening and unlocking during shipping is further enhanced by configuring the nozzle such that it snaps into the actuator via a snap closure when in the folded position. The actuator nozzle is unfolded after the package is delivered and ready for use.

The folding nozzle equipped pump actuator forms part of a hand pump with incorporates a pump assembly comprising upper and lower pump bodies and a sliding collar which controls the inlet of fluid to be dispensed into fluid passages in the pump assembly and subsequently into the pump actuator. The hand pump further includes upper and lower check valves to prevent back flowing of the fluid to be dispensed into the dispenser bottle.

A feature of the hand pump 10 of the present invention is that when the nozzle is in the folded position, it can be used as an "eye mark" during the automated filling of fluid dispenser bottles and subsequent installation of hand pumps on the dispenser bottles. The nozzle may be used as an eye mark because it has a narrow rectangular shape that can be made in a contrasting color with respect to the pump actuator. The nozzle being of a contrasting color and having a narrow rectangular shape will appear as a vertical line to an optical sensor. Optical sensors are commonly used in automated filling and assembly equipment to fill fluid dispenser bottles and to install hand pumps on the dispenser bottles. The orientation of the nozzle may also be important when products are put on public display such as in retail stores, as retailers typically prefer that product containers of this type have a uniform appearance.

The eye mark formed by the nozzle of the present invention hand pump, may be used by automated equipment to position a hand pump in a desired position with respect to a filled dispenser bottle. A typical process is a follows: a dispenser bottle is filled with product on a conveyer belt. The hand pump is dropped on the bottle. The filled dispenser bottle along with the hand pump is lined up on the conveyer moving towards a capping device which grips a closure of the hand pump and rotates the closure such that internal threads in the closure engage external threads on the dispenser bottle and screws the closure and hence the hand pump to the dispenser bottle.

The inclusion of an Eye-Mark on the pump actuator assists the automated filling equipment in properly locating the hand pump on the dispenser bottle. The above and other advantages of the hand pump of the present invention will be described in more detail below.

DETAILED DESCRIPTION OF THE PREFERRED EMBODIMENTS

The present invention will now be described more fully hereinafter with reference to the accompanying drawings, in which preferred embodiments of the invention are shown. The invention may, however, be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Description of the Component Parts

Figure 1:
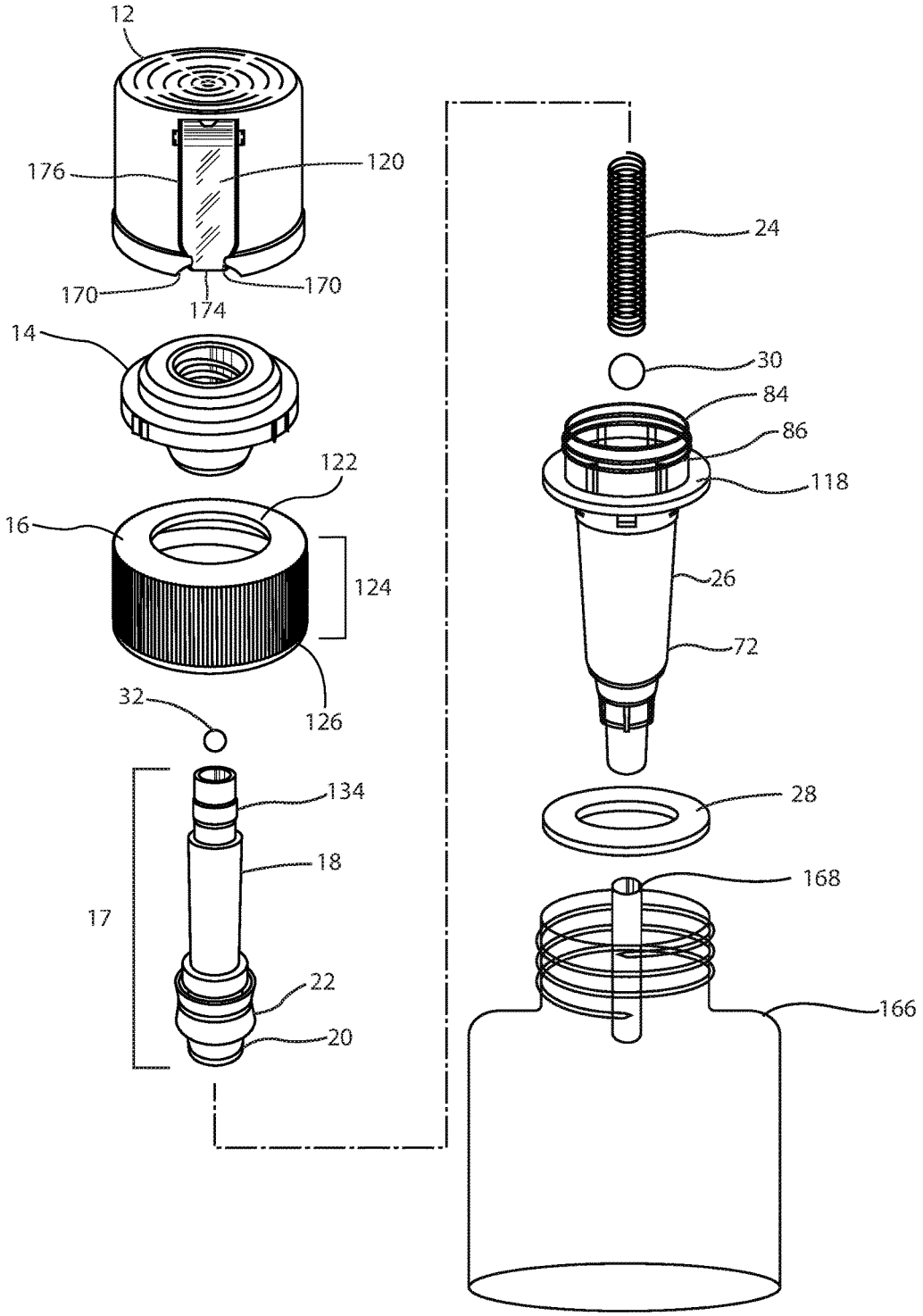
FIG. 1 is an exploded, perspective view of a hand pump of the present invention.
Figure 2A:
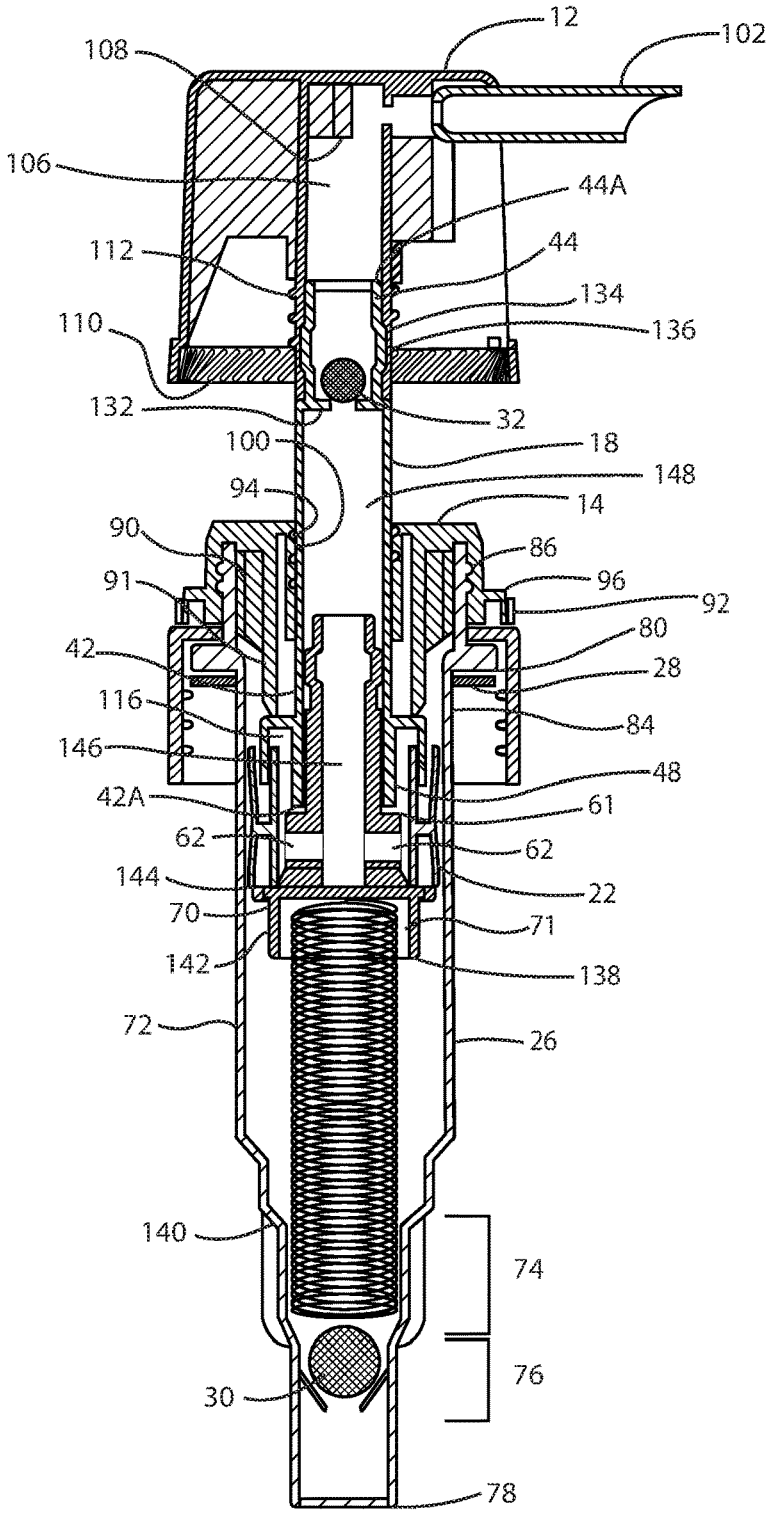
FIG. 2A is a cross-sectional view of the hand pump of FIG. 1, showing the pump's actuator in a fully extended position with a folding nozzle deployed.
Figure 2B:
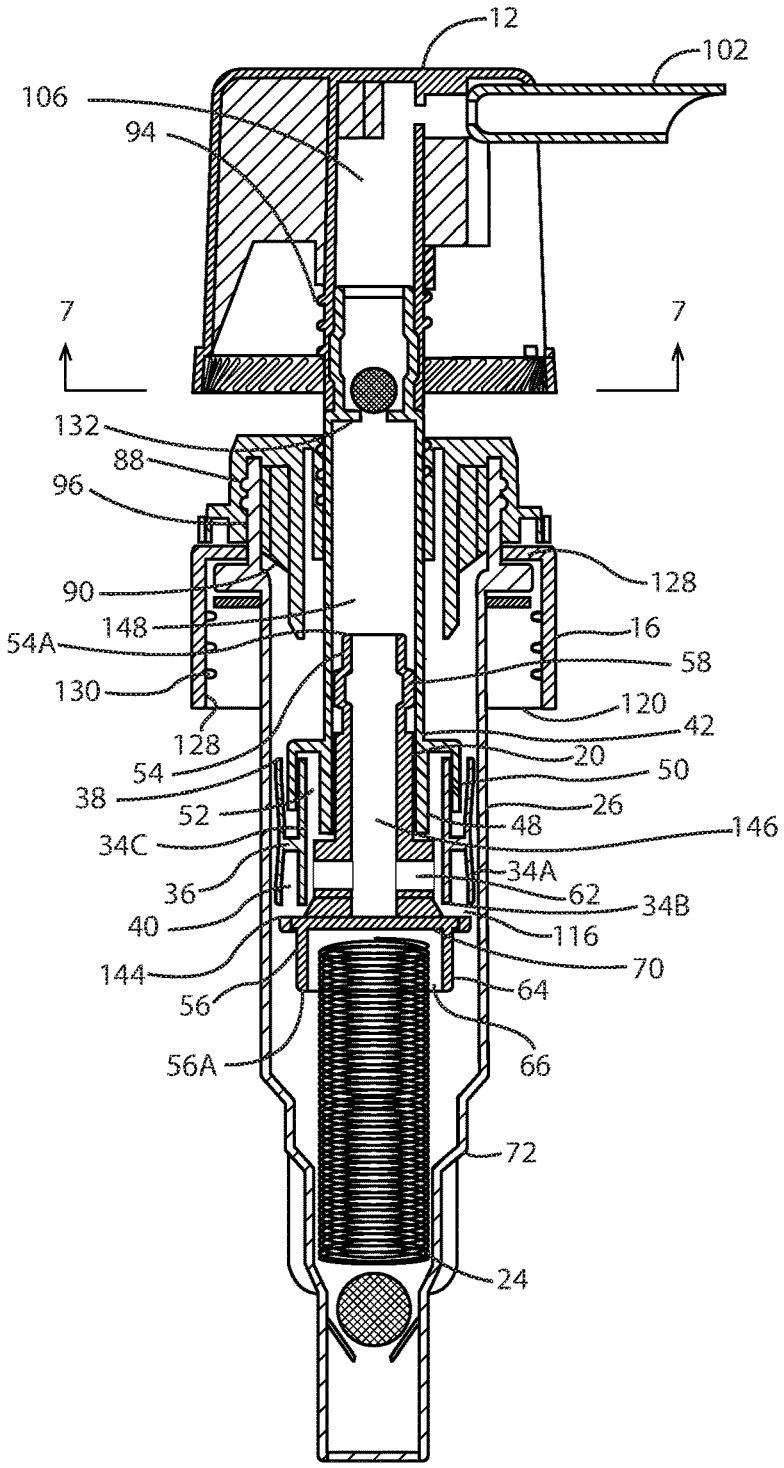
FIG. 2B is a cross-sectional view of the hand pump of FIG. 1, showing the pump with the actuator in a partially depressed position with the folding nozzle deployed.

Referring to FIGS. 1, 2A and 2B, the hand pump 10 of the present invention comprises an actuator 12, a chaplet 14, a closure 16, a pump body assembly 17, a pump housing 26, a compression spring 24, an upper check ball 32, a lower check ball 30 and a closure gasket 28. The pump body assembly 17 includes an upper pump body 18, a lower pump body 20, and a sliding collar 22, wherein the sliding collar 22 is slidable about a portion of the upper and lower pump bodies 18 and 20 to open a fluid path through holes 62 in the lower pump body 20 to fluid passages 146 and 148 in the lower and upper pump bodies 20 and 18, respectively.

With continued reference to FIGS. 1, 2A and 2*b*, the sliding collar 22 has an exterior cylindrical wall 34A and interior cylindrical wall 34B. The exterior and interior cylindrical walls 34A and 34B are bisected by a radial rib 36. Formed therebetween exterior cylindrical wall 34A and interior cylindrical wall 34B and above the radial rib 36 is an upper circular channel 38. Formed therebetween exterior cylindrical wall 34A and interior cylindrical wall 34B and below the radial rib 36 is a lower circular channel 40.

With reference to FIGS. 1, 2A and 2*b*, the upper pump body 18 includes the fluid passage 148, a lower portion 42 having a lower end 42A and an upper portion 44 having a fluid outlet 44A. The upper portion 44 also includes a check ball retainer 132 (wherein the check ball 32 and check ball retainer 132 comprise an upper check valve) and a bulbous section 134. The lower portion 42 of the upper pump body 18 includes an interior circular wall portion 48 and an exterior circular wall portion 50 which form a circular channel 52 therebetween.

The lower pump body 20 includes the fluid passage 146, an upper portion 54 having a fluid outlet 54A and a lower portion 56 having fluid inlet holes 62 and a lower end 56A. The upper portion 54 includes a bulbous portion 58. The lower portion 56 includes a stop surface 144. The lower portion 56 also includes an exterior circular wall 64 and interior circular wall 66 forming a piston 70 therebetween. The piston 70 includes a cup-shaped spring seat 71 for the compression spring 24.

With reference to FIGS. 1, 2A and 2*b*, the pump housing 26 includes a generally tubular main body portion 72, having an upper end 84 and a fluid inlet 78, an engagement surface 118 and a sealing surface 80. Located adjacent the fluid inlet 78 is a check ball retainer 76. Located adjacent the check ball retainer is a spring seat portion 74. The upper end 84 of the pump housing 26 also includes plurality of circular ribs 86.

With reference to FIGS. 1, 2A-2*b*, the closure 16 comprises a generally hollow cylindrical body 124 having a lower opening 120 and an upper opening 122 and an engagement surface 128. An exterior surface of closure 16 may include a textured surface 126 to provide the closure 16 with non-slip characteristics. An interior wall 128 of the closure 16 is equipped with threads 130 for engaging a container of fluid to be dispensed (not shown). The closure 16 of the present invention hand pump is preferably formed free of any sharp edges or protrusions which may catch on other containers or packaging during shipping, which may cause loosening of the closure 16 during shipping.

With reference to FIGS. 1, 2A-2*b* and 5-6, the chaplet 14 includes a plurality of ribs 90 oriented radially about a generally circular body portion 91. Disposed on an interior wall 96 of the chaplet 14 are a plurality of circular grooves 88. Disposed upon a generally circular outer surface 98 are a plurality of serrations 92, best shown in FIGS. 5-7. Disposed upon an inside diameter 100 of the chaplet 14 is a screw thread 94.

Figure 3:
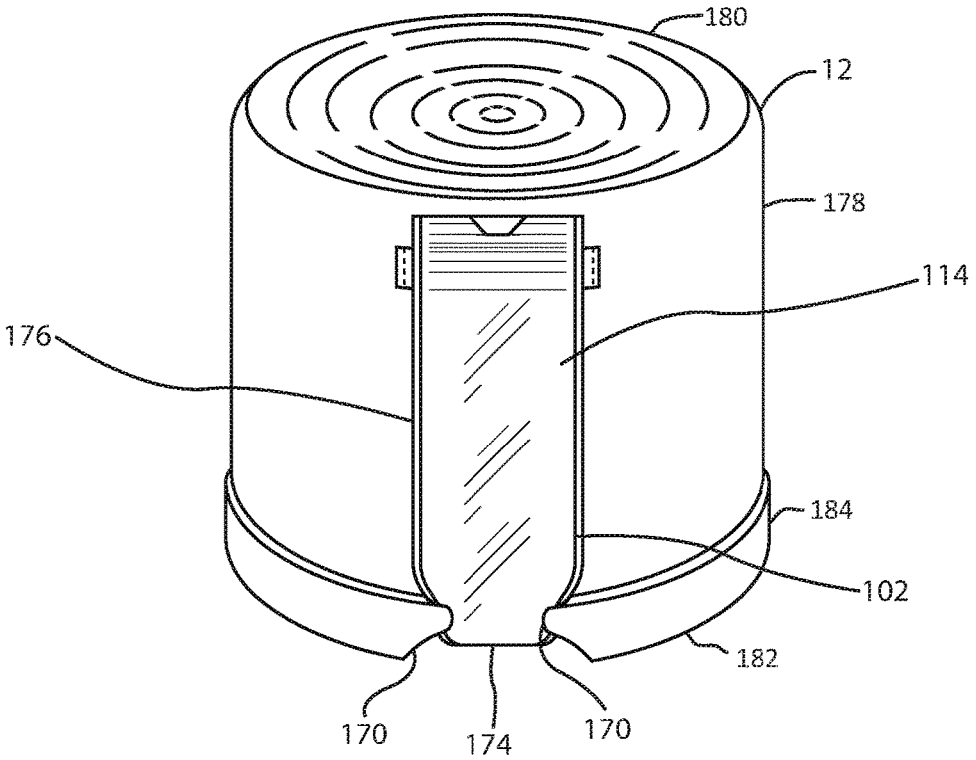
FIG. 3 an enlarged perspective view of the actuator of the hand pump of FIG. 1, showing the nozzle in a folded position.
Figure 4:
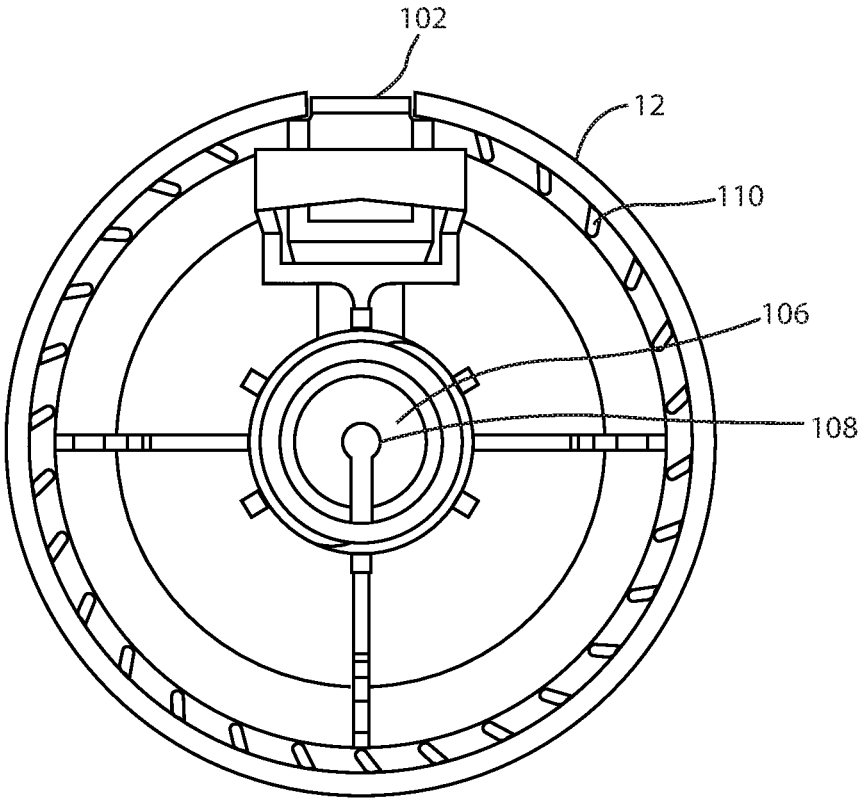
FIG. 4 is a bottom plan view of the actuator of the hand pump of FIG. 1.
Figure 5:
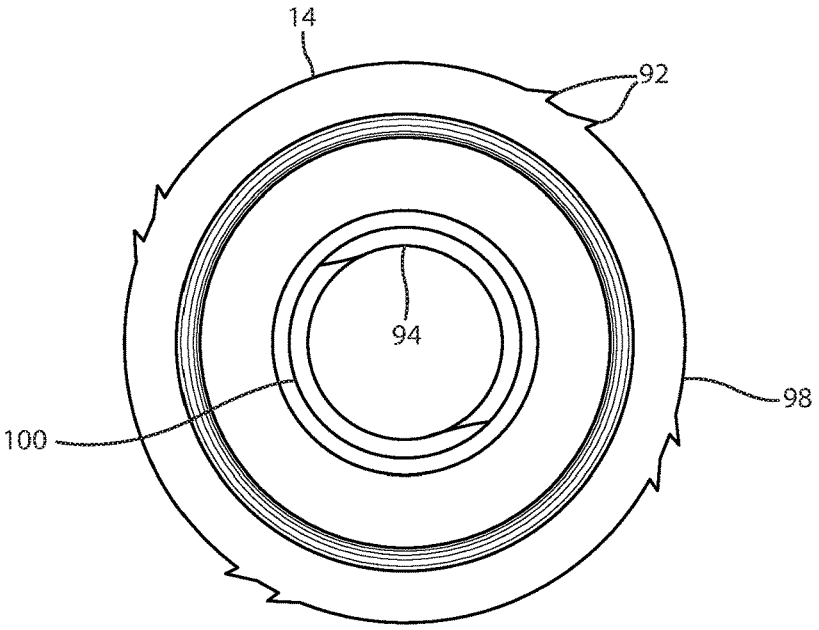
FIG. 5 is a top plan view of a chaplet of the hand pump of FIG. 1.
Figure 6:
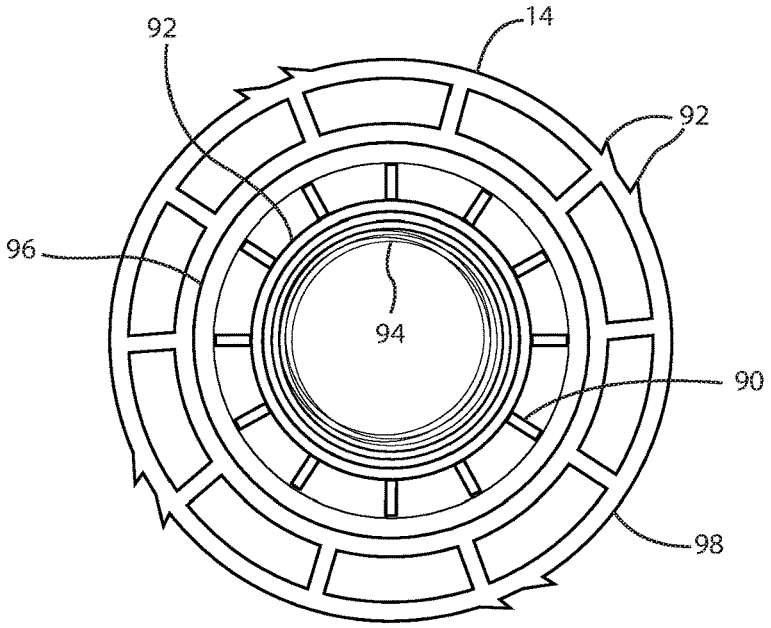
FIG. 6 is a bottom plan view of the chaplet of the hand pump of FIG. 1.

With reference to FIGS. 1, 2A-2*b* and 3-4, the actuator 12 is in the form of a cap having a flip open dispensing nozzle 102 which is movable between an open position (see FIGS. 2A and 2B) and a closed position (see FIGS. 1 and 3). The actuator 12 has a tapered cylindrical body 178 having an upper end 180 and a lower end 182 and an outwardly extending ring 184 disposed about the tapered cylindrical body 178 adjacent the lower end 182. The actuator 12 includes a fluid passage 106, check ball stop 108, and a plurality of nubs 110, and a screw thread 112. The actuator may optionally be equipped with an eye mark 114 (see FIG. 3) which may be used to align the hand pump 10 during installation by automated equipment. The nozzle 102 and actuator 12, when the nozzle 102 is folded, have a tapered cylindrical exterior surface. The closure 16 has a cylindrical exterior surface. When the actuator 12 is locked to the chaplet 14 and the nozzle 102 is folded, the cylindrical surface of the closure transitions to the tapered cylindrical surface of the actuator, wherein both surfaces should preferably be free of any sharp edges, surface discontinuities or protrusions, as such sharp edges, surface discontinuities or protrusions have a tendency to catch on other containers or packaging materials during shipping and therein tend to cause the actuator or closure to loosen during shipping which is undesirable as product in the fluid dispenser bottle 166 may then leak from the bottle 166 or hand pump 10.

Figure 2C:
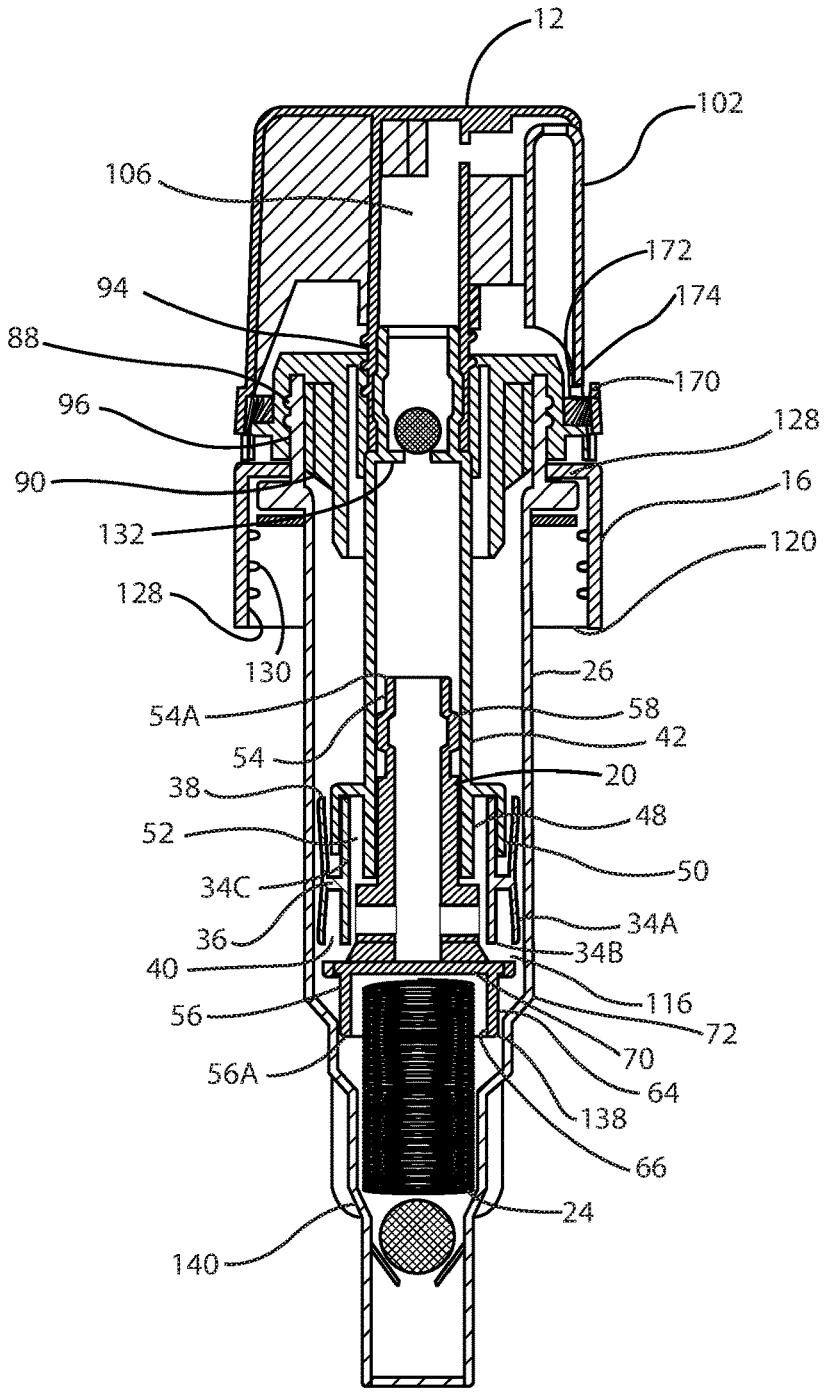
FIG. 2C is a cross-sectional view of the hand pump of FIG. 1, showing the pump in a second locked position with the folding nozzle folded.

With particular reference to FIGS. 1, 2C and 3, the actuator 12 also includes snap tabs 170 located about an opening 176 in the actuator 12 for receipt of the nozzle 102, when the nozzle 102 is in the folded position. The snap tabs 170 retain the nozzle 102 in the folded and locked position by snapping over an end portion 174 of the nozzle 102. When folded and locked, the end portion 174 of the nozzle 102 rests upon a blocking portion 172 (see FIG. 2C) of the actuator 12. When the nozzle 102 is folded and the actuator 12 is locked to the chaplet 14, the nozzle 102 may not be unfolded until the actuator 12 is unlocked from the chaplet 14 because a gap between the end 174 of the nozzle 102 and the closure 16 is insufficient to allow the nozzle 102 to be unsnapped by packaging or adjacent bottles during shipping. Similarly, a user is unable to unfold the actuator with his or fingers.

The hand pump 10 of the present invention utilizing the actuator 12 with the folding nozzle 102 is particularly well-suited for use in e-commerce where the hand pump 10 and a filled dispenser bottle 166 are commonly shipped unboxed. The folding nozzle 102 of the actuator 12, in addition to eliminating the protrusion of a conventional nozzle contributes to the prevention of leakage from the hand pump 10 in the event the hand pump 10 and dispenser bottle 166 are inverted during shipping and further helps to prevent the actuator 12 from loosening during shipping.

Assembly of the Components

Assembly of the hand pump 10 of the present invention will typically take place as follows. First, sliding collar 22 is placed on the upper pump body 18, i.e. the exterior wall 50 of the upper pump body 18 engages the upper circular channel 38 of the sliding collar 22 by sliding within the circular channel 38. Next, the upper portion 54 of the lower pump body 20 is pressed into the lower portion 42 of the upper pump body 18. The upper and lower pump bodies 18 and 20 are configured such that the bulbous section 58 of the lower pump body 20 is a press fit or snap fit inside the lower portion 42 of the upper pump body 18. Stop surface 61 of lower pump body 20 and fluid inlet 42A of the upper pump body 18 function to control the insertion depth of the lower pump body 20 into the upper pump body 18, i.e. when fluid inlet 42A abuts stop surface 61, insertion is complete.

Upon assembly of the upper and lower pump bodies 18 and 20 and the sliding collar 22, thus forming the pump body assembly 17, the sliding collar is free to slide up and down the pump bodies by the width of a gap 116. FIG. 2A shows the location of the gap when the actuator 12 of the hand pump 10 is in a fully extended position. FIG. 2B shows the location of gap 116 when the actuator 12 is in a depressed position.

Subsequently, the lower check ball 30 is inserted in the pump housing 26 along with the compression spring 24. After which the pump housing assembly 17 is inserted in the pump housing 26 such that the compression spring 26 seats in the spring seat 71 of the piston 70. Next, the closure 16 is placed over the open end 84 of the pump housing 26 such that the engagement surface 128 of the closure 16 abuts the engagement surface 118 (see FIG. 1) of the pump housing 26.

Subsequently, the chaplet 14 is inserted into the pump housing 26 and pressed into place. That is, the generally circular body portion 91 of the chaplet 14 is pressed or snapped into the open end 84 of the pump housing 26 such that the open end 84 is forced between the plurality of radially spaced ribs 90 of the chaplet 14, such that the circular ribs 86 of the pump housing 26 (see FIG. 1) engage the circular grooves 88 of the chaplet 14. As shown by FIGS. 2A and 2*b*, this arrangement results in the closure 16 being captured or sandwiched between the pump housing 26 and the chaplet 14.

Subsequently, the upper check ball 32 is dropped into the upper portion 44 of the upper pump body 18 where it rests upon the check ball retainer 132. Thereafter, the actuator 12 is pressed or snapped into place on the upper portion 44 of the upper pump body 18. That is, upper portion 44 of the upper pump body 18 is pressed into the fluid passage 106 of the actuator 12 until the bulbous portion 134 of the upper pump body 18 engages a retention feature 136 in the fluid dispensing passage 106 of the actuator 12. The retention feature 136 may be a pocket in the wall of fluid passage 106, or a pair of ribs or other physical feature serving to securely capture the bulbous portion 134 of the upper pump body 18. The check ball stop 108 of the actuator 12 prevents the upper check ball 32 from entering the nozzle 102.

Next, a gasket 28 is inserted through the closure 16 such that it abuts the sealing surface 80 of the pump housing 26. The gasket 28 functions to seal a fluid dispenser bottle 166 to the pump housing 26. Prior to installing the hand pump 10 on a dispenser bottle 166, typically a dip tube 168 will be attached to the fluid inlet 78 of the pump housing 26. The length of the dip tube 168 will be sized to fit the depth of the dispenser bottle 166.

The above sequence of steps is one preferred method of assembling the hand pump 10 of the present invention. The hand pump 10 may be assembled by hand or via automated processes.

Operation of the Hand Pump

Figure 7:
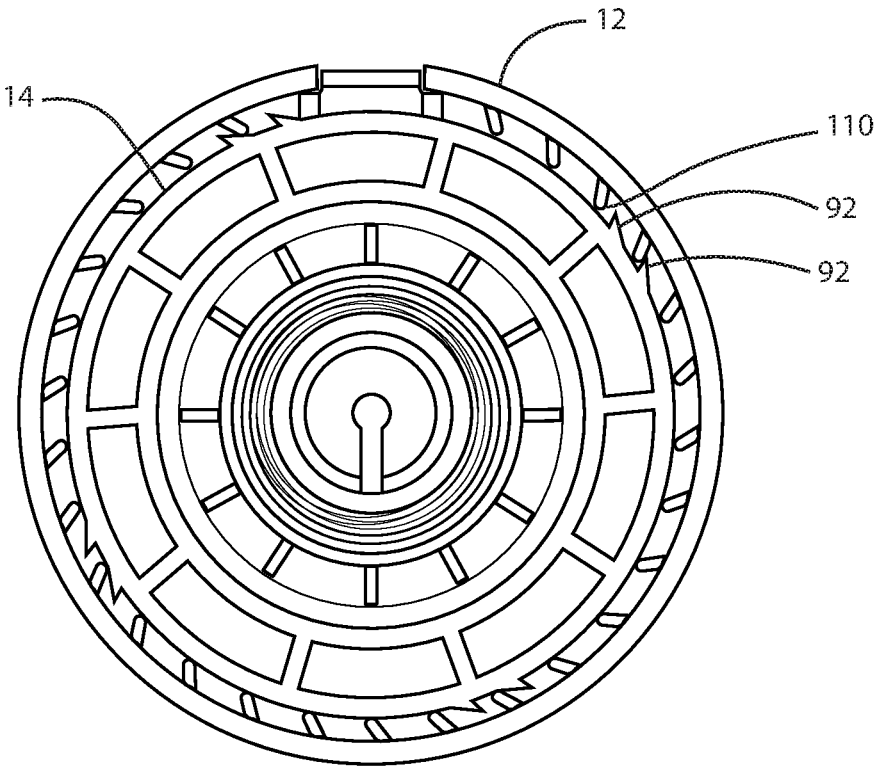
FIG. 7 is sectional view sectional view taken along the line 7-7 of FIG. 6, showing an interface between the actuator and the chaplet of the hand pump of FIG. 1.

The hand pump 10 will typically be shipped in the closed and locked position as shown in FIG. 2C. In the locked position, the actuator 12 is pressed downwardly and rotated such that the threads 112 of the actuator 12 engage the threads 94 of the chaplet 14 and therein lock the lock the actuator 12 in place. In place of a thread locking system, a bayonet lock may be used. With reference to FIG. 7, during the locking process, the nubs 110 on the actuator 12 engage the serrations 92 on the chaplet 14 and therein create resistance to rotation of the actuator 12. This resistance gives a user of the hand pump 10 a sensory feedback during opening and closing of the hand pump 10.

With reference to FIG. 2*c*, in the locked position, a lower edge 138 of the piston 70 of the lower pump body 20 abuts a tapered sealing surface 140 on the pump housing 26 and therein prevents fluid in the dispenser bottle 166 from flowing through the hand pump 10 in the event the pump is inverted during shipping.

With reference to FIG. 2B, FIG. 2B shows the actuator 12 in the partially depressed position, when the actuator 12 is being depressed and the flip-open nozzle 102 is open, the slide collar 22 slides upwardly and moves off a sealing surface 144 of the lower pump body 20 and therein allows fluid to flow through holes 62 in the lower pump body 20 and into a fluid passage 146 of the lower pump body 20. Upon pressing the actuator 12, air pressure (in the case of first actuation) or fluid pressure (in the case of subsequent actuations) lifts the lower check ball 30 off its seat and causes fluid from a dip tube 168 in a dispenser bottle 166 to be drawn upwards into the pump housing 26.

The fluid subsequently moves upwardly through the pump housing 26 and through the holes 62 in the lower pump body 20, upwardly through the fluid passages 146 and 148 in the lower and upper pump bodies, respectively, and lifts the upper check ball 30 off its seat and then proceeds into the fluid passage 106 in the actuator 12 and out the nozzle 102.

With reference to FIG. 2A, when a user releases the actuator 12, spring force from the compression spring 24 drives the pump body assembly 17 upwardly. This upwards motion causes the slide collar 22 to slide downwardly and therein seal off the holes 62 leading to the fluid passage 146 in lower pump body 20. Gravity causes the lower and upper check balls 30 and 32 to return to their seats and therein prevents fluid from backflowing back into the dispenser bottle 166.

As shown, the present invention hand pump 10 utilizes an actuator 12 equipped with a folding nozzle 102. The hand pump 10 is well-suited for use in e-commerce where the hand pump 10 and filled dispenser container are commonly shipped unboxed. The actuator 12 and folding nozzle 102, in addition to eliminating the protrusion of a conventional nozzle, also contribute to pump sealing in the event the hand pump 10 and dispenser bottle 166 are inverted during shipping. The folding nozzle 102 also assists to prevent the actuator 12 from loosening during shipping. The actuator nozzle is unfolded after the package is delivered and ready for use.

The eye mark 114 (see FIG. 1) of the folding nozzle 102 assists in the automated filling of dispenser bottles 166 and the subsequent installation of hand pumps of the present invention 10 on dispenser bottles 166. The nozzle 102 is well-suited to use as an eye mark because it has a narrow rectangular shape that can be made in a contrasting color with respect to the actuator 12. The nozzle 102 being of a contrasting color and having a narrow rectangular shape will appear as a vertical line to an optical sensor. Optical sensors are commonly used in automated filling and assembly equipment to fill fluid containers and to install hand pumps on the containers. The inclusion of an Eye-Mark on the pump actuator assists the automated filling equipment in properly locating the hand pump on the dispenser bottle 166.

Alternative Integrated Chaplet-Closure Design

Figure 8:
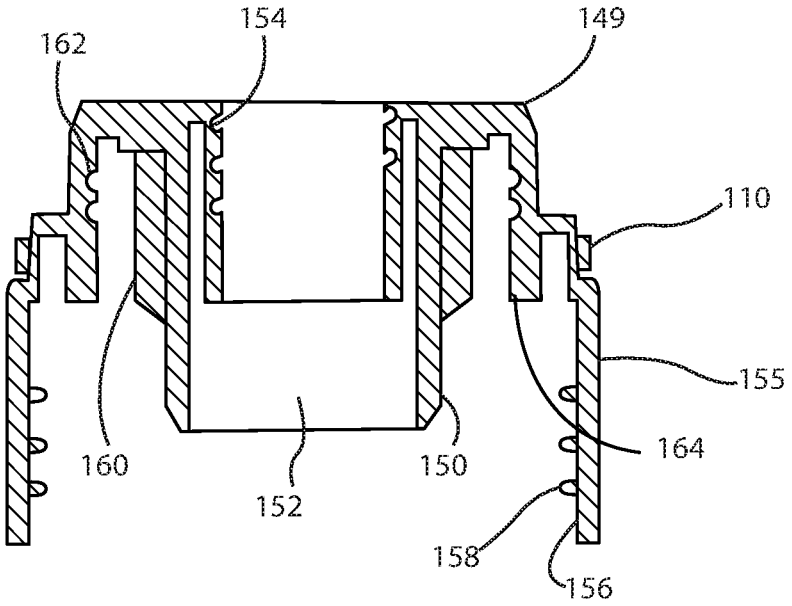
FIG. 8 is a cross-sectional view of an integrated chaplet-closure.
Figure 9:
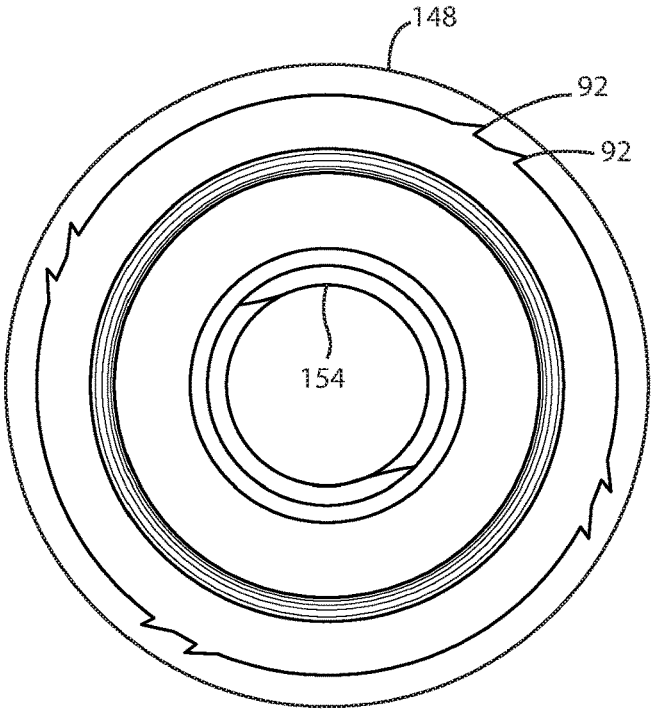
FIG. 9 is a top plan view of the integrated chaplet-closure of FIG. 8.
Figure 10:
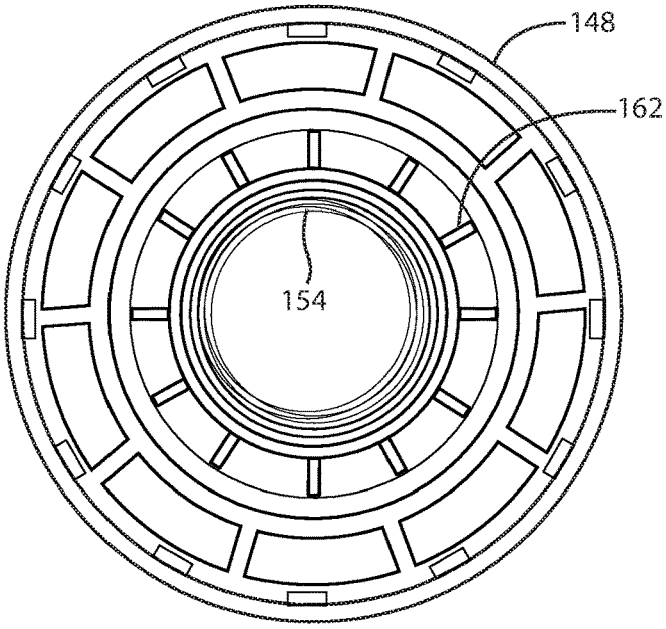
FIG. 10 is a bottom plan view of the integrated chaplet-closure of FIG. 8.

Referring now to FIG. 8-10, an alternative embodiment for the chaplet 14 and closure 16 is shown. In this embodiment, the chaplet 14 and closure 16 have been integrated to form a single unit. The integrated chaplet-closure 148 comprises a chaplet portion 149 and a closure portion 155. The chaplet portion 149 includes a generally hollow cylindrical inner body 150 having a pump bore 152 for receipt of the pump assembly 17. The pump bore 152 includes threads 154 which engage with mating threads 112 of the actuator 12. The threads 154 of the chaplet portion 149 and the threads 112 of the actuator 12 allow the actuator to be screwed onto the integrated chaplet-closure 148 and therein locked into a fully depressed position for shipping. The integrated chaplet-closure 148 also includes serrations 92 which engage nubs 110 on the actuator (see FIG. 7) and therein provide a resistance, i.e. a "feel" or feedback to a user's action of screwing and unscrewing the actuator from the integrated chaplet-closure 148.

The closure portion 155 of the integrated chaplet-closure 148 includes a generally hollow cylindrical outer body 156 which includes interior screw threads 158 which are sized to engage with threads on a dispenser bottle 166. The integrated chaplet-closure 48 also includes a plurality of ribs 160 oriented radially about the generally circular inner body 150 and a plurality of circular grooves 162 disposed on a wall 164 of the integrated chaplet-closure 148. These features allow the pump housing 26 to be press or snap fit into the integrated chaplet-closure 148, in the same manner as for the non-integrated chaplet 14 and closure 16. The integrated chaplet-closure 148 simplifies the pump design and therein reduces assembly costs.

While the present invention has been described with regards to particular embodiments, it is recognized that additional variations of the present invention may be devised without departing from the inventive concept.

What is claimed is:

1. A manually operated dispensing pump comprising:

an actuator, a chaplet, a closure, a pump body assembly, a compression spring, and a pump housing;

wherein the actuator is equipped with a fluid passage in fluid communication with a nozzle and has a fully extended position, a partially depressed position, and a locked position;

wherein the nozzle is foldable between a closed position which inhibits fluid flow and an open position which allows fluid flow, and wherein the nozzle is of a contrasting color to that of the actuator, whereby the nozzle acts as an eye mark;

wherein the nozzle folds fully within the actuator;

wherein the actuator and the nozzle, when the nozzle is folded, have a tapered cylindrical exterior surface;

wherein the pump body assembly is fixed to the actuator and includes a fluid passage in fluid communication with the fluid passage in the actuator and a sliding collar;

the collar slidable between a closed position which prevents fluid in the pump housing from entering a fluid passage in the pump body assembly when the actuator is fully extended and an open position which allows fluid from the pump housing to enter the fluid passage in the pump body assembly when the actuator is partially depressed;

the pump housing being equipped with a check valve at a fluid inlet and wherein the compression spring is disposed in the pump housing;

the compression spring engaging a piston of the pump body assembly and the housing at a position adjacent the fluid inlet, wherein the compression spring biases the actuator to the fully extended position;

the closure is disposed between the pump housing and the chaplet, wherein the pump housing is fixed to the chaplet; and wherein the actuator includes a screw thread engagable with a mating thread formed on the chaplet, wherein engagement of the screw threads puts the actuator into the locked position;

means to provide resistance when the actuator is locked or unlocked from the chaplet, wherein the means to provide resistance comprises nubs disposed about an interior surface of the actuator which engage with serrations disposed about an exterior surface of the chaplet; and wherein the actuator includes an opening for receipt of the nozzle, a blocking portion and at least one snap tab disposed on a vertical side of the opening;

wherein when in the folded position, an end of the nozzle abuts the blocking portion and the at least one snap tab secures the nozzle within the opening;

wherein when the nozzle is in the folded position and the actuator is in the locked position, the nozzle cannot be unfolded.

2. The manually operated dispensing pump of claim 1, wherein the pump body assembly includes a pressure operated check valve disposed in an outlet of the fluid passage in the pump body assembly.

3. The manually operated dispensing pump of claim 1, wherein the closure has a cylindrical exterior surface and, wherein the actuator and closure, form a cylindrical exterior surface transitioning to a tapered cylindrical exterior surface.

4. The manually operated dispensing pump of claim 1, wherein the pump body assembly comprises a lower pump body, and an upper pump body which snap together wherein the sliding collar is disposed between the lower pump body and upper pump body.

5. The manually operated dispensing pump of claim 1, wherein the chaplet is fully enclosed within the actuator when the actuator is in the locked position.

6. The manually operated dispensing pump of claim 1, wherein the actuator has a tapered cylindrical body have an upper end and a lower end and an outwardly extending ring disposed about the tapered cylindrical body at its lower end.

7. A manually operated dispensing pump comprising:

an actuator, a chaplet, a closure, a pump body assembly, a compression spring, and a pump housing;

wherein the actuator is equipped with a fluid passage in fluid communication with the nozzle and has a fully extended position, a partially depressed position, and a locked position;

wherein a nozzle is foldable between a closed position which inhibits fluid flow and an open position which allows fluid flow;

wherein the nozzle folds fully within the actuator;

wherein the actuator and the nozzle, when the nozzle is folded, have a tapered cylindrical exterior surface;

wherein the pump body assembly is fixed to the actuator and includes a fluid passage in fluid communication with the fluid passage in the actuator and a sliding collar;

the collar slidable between a closed position which prevents fluid in the pump housing from entering a fluid passage in the pump body assembly when the actuator is fully extended and an open position which allows fluid from the pump housing to enter the fluid passage in the pump body assembly when the actuator is partially depressed;

the pump housing being equipped with a check valve at a fluid inlet and wherein the compression spring is disposed in the pump housing;

the compression spring engaging a piston of the pump body assembly and the housing at a position adjacent the fluid inlet, wherein the compression spring biases the actuator to the fully extended position; and the closure is disposed between the pump housing and the chaplet, wherein the pump housing is fixed to the chaplet; and means for holding the actuator in the locked position;

wherein the actuator includes an opening for receipt of the nozzle, a blocking portion and at least one snap tab disposed on a vertical side of the opening;

wherein when in the folded position, an end of the nozzle abuts the blocking portion and the at least one snap tab secures the nozzle within the opening;

wherein when the nozzle is in the folded position and the actuator is in the locked position, the nozzle cannot be unfolded.

8. The manually operated dispensing pump of claim 7, wherein the closure has a cylindrical exterior surface and, wherein the actuator and closure, form a cylindrical exterior surface transitioning to a tapered cylindrical exterior surface.

9. The manually operated dispensing pump of claim 7, wherein the means for holding the actuator in a locked position comprises a screw thread formed on the actuator and a mating screw thread formed on the chaplet.

10. The manually operated dispensing pump of claim 7, wherein the actuator and chaplet include a means to provide resistance when the actuator is locked or unlocked from the chaplet.

11. The manually operated dispensing pump of claim 10, wherein the means to provide resistance comprises nubs disposed about an interior surface of the actuator which engage with serrations disposed about an exterior surface of the chaplet.

12. The manually operated dispensing pump of claim 7, wherein the pump body assembly includes a pressure operated check valve disposed in an outlet of the fluid passage in the pump body assembly.

13. The manually operated dispensing pump of claim 7, wherein the pump body assembly comprises a lower pump body, and an upper pump body which snap together wherein the sliding collar is disposed between the lower pump body and upper pump body.

14. The manually operated dispensing pump of claim 7, wherein the chaplet is fully enclosed within the actuator when the actuator is in the locked position.

15. The manually operated dispensing pump of claim 7, wherein the actuator has a tapered cylindrical body have an upper end and a lower end and an outwardly extending ring disposed about the tapered cylindrical body at its lower end.

16. A manually operated dispensing pump comprising:

an actuator, an integrated chaplet-closure having a chaplet portion and a closure portion, a pump body assembly, a compression spring, and a pump housing;

wherein the actuator is equipped with a fluid passage in fluid communication with the nozzle and has a fully extended position, a partially depressed position, and a locked position;

wherein a nozzle is foldable between a closed position which inhibits fluid flow and an open position which allows fluid flow;

wherein the nozzle folds fully within the actuator;

wherein the actuator and the nozzle, when the nozzle is folded, have a tapered cylindrical exterior surface;

wherein the pump body assembly is fixed to the actuator and includes a fluid passage in fluid communication with the fluid passage in the actuator and a sliding collar;

the collar slidable between a closed position which prevents fluid in the pump housing from entering a fluid passage in the pump body assembly when the actuator is fully extended and an open position which allows fluid from the pump housing to enter the fluid passage in the pump body assembly when the actuator is partially depressed;

the pump housing being equipped with a check valve at a fluid inlet and wherein the compression spring is disposed in the pump housing;

the compression spring engaging a piston of the pump body assembly and the housing at a position adjacent the fluid inlet, wherein the compression spring biases the actuator to the fully extended position; and the pump housing being fixed to the integrated chaplet-closure; and means for holding the actuator in the locked position;

wherein the actuator includes an opening for receipt of the nozzle, a blocking portion and at least one snap tab disposed on a vertical side of the opening;

wherein when in the folded position, an end of the nozzle abuts the blocking portion and the at least one snap tab secures the nozzle within the opening;

wherein when the nozzle is in the folded position and the actuator is in the locked position, the nozzle cannot be unfolded.

17. The manually operated dispensing pump of claim 16, wherein the closure has a cylindrical exterior surface and, wherein the actuator and closure, form a cylindrical exterior surface transitioning to a tapered cylindrical exterior surface.

18. The manually operated dispensing pump of claim 16, wherein the means for holding the actuator in a locked position comprises a screw thread formed on the actuator and a mating screw thread formed on the integrated chaplet-closure.

19. The manually operated dispensing pump of claim 18, wherein the actuator and integrated chaplet-closure include a means to provide resistance when the actuator is locked or unlocked from the chaplet.

20. The manually operated dispensing pump of claim 19, wherein the means to provide resistance comprises nubs disposed about an interior surface of the actuator which engage with serrations disposed about an exterior surface of the integrated chaplet-closure.

21. The manually operated dispensing pump of claim 16, wherein the pump body assembly includes a pressure operated check valve disposed in an outlet of the fluid passage in the pump body assembly.

22. The manually operated dispensing pump of claim 16, wherein the pump body assembly comprises a lower pump body, and an upper pump body which snap together wherein the sliding collar is disposed between the lower pump body and upper pump body.

* * * * *